United States Patent [19]

Benoit et al.

[11] 4,302,705

[45] Nov. 24, 1981

[54] CAPACITIVE COUPLING DEVICE FOR AN ELECTRON TUBE

[75] Inventors: Michel Benoit; Pierre Gerlach, both of Paris, France

[73] Assignee: Thomson-CSF, Paris, France

[21] Appl. No.: 76,775

[22] Filed: Sep. 18, 1979

[30] Foreign Application Priority Data

Sep. 22, 1978 [FR] France ..... 78 27254

[51] Int. Cl.[3] ..... H01J 7/46; H01J 19/80

[52] U.S. Cl. ..... 315/39; 333/24 C

[58] Field of Search ..... 315/39; 333/24 C

[56] References Cited

U.S. PATENT DOCUMENTS

| | | | |
|---|---|---|---|
| 2,619,597 | 11/1952 | Mlynczak | 315/39 X |
| 2,643,302 | 6/1953 | Bradburd | 315/39 X |
| 2,895,076 | 7/1959 | Stocker | 315/39 X |
| 3,153,765 | 10/1964 | Weaver | 315/39 X |
| 3,488,555 | 1/1970 | Fritz | 315/39 |
| 4,174,492 | 11/1979 | Holle | 315/39 |

*Primary Examiner*—Saxfield Chatmon, Jr.
*Attorney, Agent, or Firm*—Roland Plottel

[57] ABSTRACT

A coupling electrode is placed within the vacuum envelope of an electron tube of coaxial geometry which is insulated from the anode of the tube by means of an insulator. The insulator is joined to the coupling electrode and the anode of the tube by means of flanged collars. One of these collars may serve to connect the coupling electrode to one or a number of external circuits. A capacitive coupling is established between a top cap of one grid of the tube, namely the grid cap located nearest the coupling electrode, and the coupling electrode. The distance and therefore the coupling capacitance between the grid cap and the coupling electrode can be made variable by mounting the coupling electrode on a deformable metallic bellows element.

5 Claims, 2 Drawing Figures

CAPACITIVE COUPLING DEVICE FOR AN ELECTRON TUBE

Figure 1:
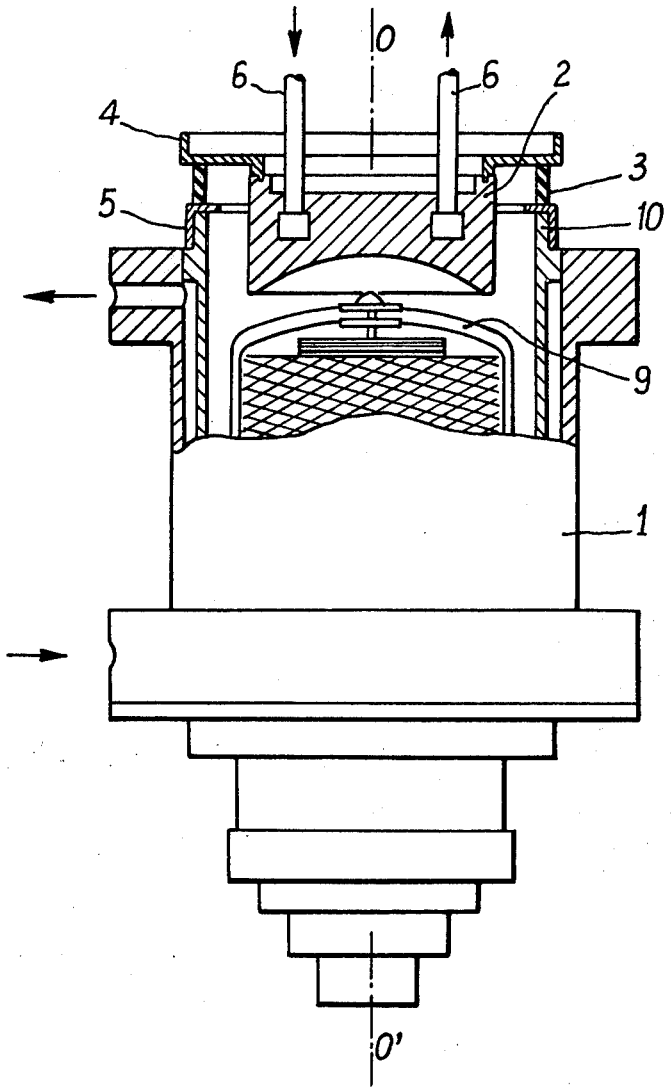

This invention relates to a capacitive coupling device for an electron tube.

The device according to the invention applies essentially to tubes of coaxial geometry such as the power triodes and tetrodes employed in broadcasting and television transmitters, radar systems, industrial high-frequency generators. However, the invention is also applicable to other types of tubes such as planar triodes.

The capacitive coupling device for an electron tube in accordance with the invention comprises:

a coupling electrode placed within the vacuum envelope of the electron tube;

means for insulating said electrode from the anode of the electron tube;

means for providing a connection between on the one hand the insulating means and on the other hand the coupling electrode and the anode, said means being employed for connecting the device to one or a number of external circuits.

A capacitive coupling is thus established between the top cap of one grid of the electron tube (said cap being located nearest the coupling electrode) and said coupling electrode.

In one embodiment of the device according to the invention, means are provided for permitting variation of the distance and therefore of the coupling capacitance between the coupling electrode and the top cap of one grid of the electron tube.

In another embodiment of the device, the means for insulating the coupling electrode from the anode of the tube are located in a zone which is not in direct line of access to that zone of the tube which is subjected to electron bombardment.

The device according to the invention offers a large number of advantages and among these can be mentioned the following:

the possibility of adjusting the value of the capacitance existing between the coupling electrode and the electron tube;

its long service life, which is even longer when the means for insulating the coupling electrode from the anode of the electron tube are located within a zone which is not in direct line of access to the electron tube zone which is subjected to electron bombardment. The means for insulating the coupling electrode are thus protected from thermal stresses which would otherwise result in failure of said means and their internal face is not liable to intercept metallic molecules which would tend to make it conductive;

integration of the device in the electron tube, thus making it possible in many applications to reduce the bulk of electron tubes provided with a device of this type;

the formation of a capacitive coupling in vacuo which ensures good voltage stability and absence of any ionization phenomenon;

a wide range of potential applications.

The device according to the invention can be employed in particular:

in order to obtain a small variation in output capacitance of the electron tube and therefore accurate adjustment of the tuning frequency of an amplifier or of a high-frequency oscillator having a fixed frequency;

as a unit for direct collection of all or part of the useful energy generated in the output circuit of the electron tube. Thus the device can be employed in order to establish a feedback or negative feedback output coupling. In the prior art, these couplings are usually effected by means of one or two "loading pallets" placed externally of the electron tube. The device according to the invention makes it possible to achieve better coupling than a "loading pallet," especially when the voltage antinode is within the electron tube;

in order to couple with damping impedances the parasitic oscillation modes which are liable to be established within the coaxial tubes. The device according to the invention which is integrated in the electron tube has the advantage of being close to the parasitic electromagnetic waves to be coupled. A sufficient coupling can thus be established even in difficult cases. The device according to the invention also has the advantage of separating the circuits which process the useful wave from those which process parasitic phenomena. When the utilization frequencies and the spurious frequencies have very different orders of magnitude, the device according to the invention can be dimensioned in such a manner as to ensure effective coupling for the waves to be damped and to ensure that the useful wave is not damped. The device thus contributes to frequency selection in addition to its coupling function.

Figure 2:
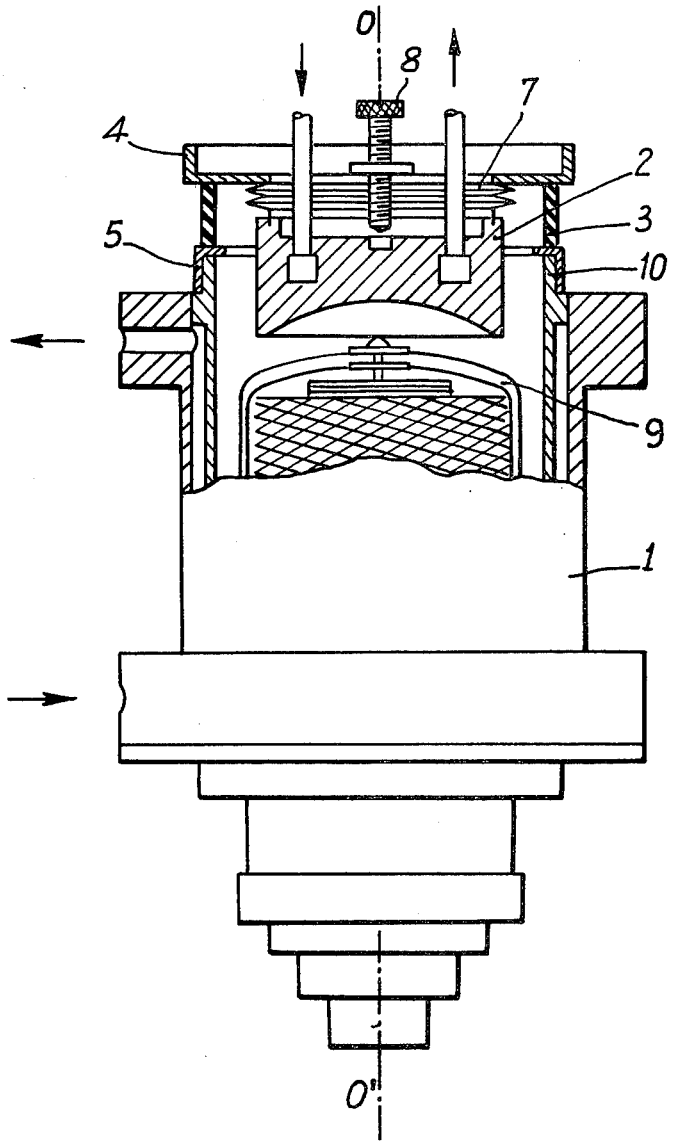

Further objectives, distinctive features and results of the invention will be brought out by the following description which is given by way of example without any limitation being implied, reference being made to FIGS. 1 and 2 of the accompanying drawings. Each figure represents a view of an electron tube of coaxial geometry, this view being taken in a direction parallel to its axis. A cutaway portion of said view shows one embodiment of a capacitive coupling device in accordance with the invention.

In both figures, the same reference numerals designate the same elements but the dimensions and proportions of the different elements have not been complied with for the sake of enhanced clarity.

The electron tube 1 chosen by way of example is of coaxial geometry and illustrated in FIGS. 1 and 2, looking in a direction parallel to the axis 0-0' of the tube. In these views, a cutaway portion shows two embodiments of the capacitive coupling device in accordance with the invention.

The coupling electrode 2 is located within the interior of the vacuum envelope of the electron tube where it is constituting the bottom of the tube. Said electrode is constituted by a mass of metal which can be copper. Means 3 are provided for insulating said coupling electrode 2 from the anode 10 of the tube. These means can be constituted by a ceramic or glass insulator which is similar to those commonly employed for insulating electron tube connections. Means 4 and 5 are provided respectively for establishing a connection between the insulating means 3 and the coupling electrode 2 and between the insulating means 3 and the anode 10 of the tube. The coupling electrode 2 and the anode 10 are usually of copper and means are required for establishing a connection between these elements and the insulating means 3 in order to prevent failures arising from differences in expansion between copper and insulator. The means 4 and 5 for establishing the connection can be constituted by flanged collars of Fe Ni Co alloy. The means for establishing the connection also serve to connect the device to one or a number of external circuits.

A capacitive coupling is thus established in vacuo between the top cap 9 of one grid of the electron tube and the coupling electrode, said top cap being located nearest said electrode. The tube grid whose top cap is nearest the coupling electrode is the screen grid in the case of a tetrode, and the grid in the case of a triode. A substantially flat capacitor as thus constituted has all the advantages of vacuum capacitors and is directly integrated in the tube itself.

In one embodiment of the device according to the invention, the insulator 3 is of cylindrical shape and located in a zone which is not in direct line of access to the tube zone which is subjected to electron bombardment. It is recalled that electron bombardment in a tube of coaxial geometry is radial. It is readily apparent that the invention is also applicable to the case in which the insulator 3 is substantially flat and projects beyond the anode 10.

Means are usually provided for cooling the coupling electrode 2. These means are usually the same as those employed for cooling the anode 10 of the tube. The coupling electrode can be air-cooled in which case it is covered by an air radiator, or by circulation of fluid usually consisting of water as shown diagrammatically in FIG. 1 and designated by the reference numeral 6. Composite solutions consisting of both air and fluid can be adopted in certain particular cases.

In FIG. 1, the capacitive coupling between the coupling electrode 2 and the top cap 9 of one grid of the tube is fixed.

In some applications of the electron tube already described, especially in order to collect either all or part of the useful energy of the output circuit of the tube, or in order to obtain a small variation in output capacitance of said tube, it is an advantage to permit a variation in distance and therefore in coupling capacitance between the coupling electrode 2 and the top cap 9.

There is shown in FIG. 2 one embodiment of the coupling device according to the invention in which provision is made for means 7 whereby the distance aforesaid and therefore the coupling capacitance can be made variable. Said means can be constituted by a deformable metallic bellows element 7 which is similar to the bellows elements employed in the technology of variable vacuum capacitors. Said bellows element 7 connects the coupling electrode 2 to the means 4 provided for establishing a connection between said electrode and the insulating means 3. As represented schematically in FIG. 2, means 8 permit displacement of the coupling electrode 2 in translational motion while being locked rotationally.

What is claimed is:

1. An electron tube having a capacitive coupling comprising in a vacuum envelope, an anode, and at least one grid, said grid having a top cap, and which in operation there is an electron bombardment towards the anode; a coupling electrode mounted with a least one face within the vacuum envelope, said face adjacent to the top cap of said grid; said electrode and grid providing said capacitive coupling an insulator for insulating said coupling electrode from the anode, said insulator being located in a zone which is not in a direct line of access to that zone of the tube which is subjected to electron bombardment; a first connector between the insulator and the coupling electrode, and a second connector between the insulator and the anode, said connectors being adapted for providing external connections to the tube.

2. A device according to claim 1, wherein said device comprises means for permitting variation of the distance and therefore of the coupling capacitance between the coupling electrode and said top cap of the grid of the electron tube, which is located adjacent the coupling electrode.

3. A device according to claim 2, wherein the means for permitting variation of the distance and therefore of the coupling capacitance between the coupling electrode and said grid are constituted by a deformable metallic bellows element, connecting the coupling electrode to the first connector; said means permitting displacement of said electrode in translational motion and no rotational motion.

4. A device according to claim 1, wherein the coupling electrode is provided with means for cooling by air and/or fluid.

5. A device according to claim 1, wherein the coupling electrode is part of the external surface of the electron tube and is positioned at one end of said tube.

* * * * *